US008471412B2

(12) United States Patent
Schmid

(10) Patent No.: US 8,471,412 B2
(45) Date of Patent: Jun. 25, 2013

(54) SWITCH ASSEMBLY, ELECTRIC CONSUMER AS WELL AS MACHINE TOOL

(75) Inventor: Markus Schmid, Wolfschlugen (DE)

(73) Assignee: Robert Bosch GmbH, Stuttgart (DE)

( * ) Notice: Subject to any disclaimer, the term of this patent is extended or adjusted under 35 U.S.C. 154(b) by 418 days.

(21) Appl. No.: 12/578,127

(22) Filed: Oct. 13, 2009

(65) Prior Publication Data

US 2010/0089727 A1 Apr. 15, 2010

(30) Foreign Application Priority Data

Oct. 13, 2008 (DE) ..... 10 2008 042 799

(51) Int. Cl.

| | |
|---|---|
| ***H01H 31/10*** | (2006.01) |
| ***H01H 33/59*** | (2006.01) |
| ***H01H 47/00*** | (2006.01) |
| ***H01H 85/46*** | (2006.01) |
| ***H01H 19/14*** | (2006.01) |

(52) U.S. Cl.

USPC ..... 307/115

(58) Field of Classification Search

USPC ..... 307/115, 141, 142; 200/50.37

See application file for complete search history.

(56) References Cited

U.S. PATENT DOCUMENTS

| | | | | |
|---|---|---|---|---|
| 5,097,184 | A * | 3/1992 | Echtler et al. | 318/139 |
| 5,651,452 | A | 7/1997 | Schaeffeler et al. | |
| 6,025,568 | A | 2/2000 | Schaeffeler et al. | |
| 2010/0078187 | A1 * | 4/2010 | Chen et al. | 173/213 |

FOREIGN PATENT DOCUMENTS

| | | |
|---|---|---|
| DE | 36 38 952 | 5/1988 |
| DE | 44 37 020 | 4/1996 |
| DE | 197 26 402 | 12/1998 |
| DE | 10 2007 005 510 | 8/2007 |

* cited by examiner

*Primary Examiner* — Carlos Amaya
(74) *Attorney, Agent, or Firm* — Merchant & Gould P.C.

(57) ABSTRACT

The invention relates to a switch assembly (1) for switching an electric consumer (2) on and off, in particular for the use in a hand machine tool, comprising a power switch (3) and a power electronic (5) for supplying the consumer (2) with electric energy. According to the invention it is provided that a help switch (6) is provided, which works together with the power electronic (5) in such a way that it supplies the electric consumer (2) with electric energy only after switching on the help switch (6). The invention furthermore relates to an electric consumer (2) as well as a machine tool.

8 Claims, 1 Drawing Sheet

SWITCH ASSEMBLY, ELECTRIC CONSUMER AS WELL AS MACHINE TOOL

This application claims benefit of Serial No. 10 2008 042 799.3, filed 13 Oct. 2008 in Germany and which application is incorporated herein by reference. To the extent appropriate, a claim of priority is made to the above disclosed applications.

TECHNICAL FIELD

There are already hand machine tools on the market like power drills, reversing hammer drills or angle grinders, etc., which comprise a power switch for switching the power supply on and off. The power switch is therefore construed in such a way that it securely switches a defined number of cycles of operation at a maximum electric voltage and maximum electric current without any damages. For the initial current limitation resistances are applied between the power switch and an electric consumer, mostly an electromotor or a power electronic is provided that is reducing at the initial current.

Such switch assemblies are for example described in DE 44 37 020 A1, DE 10 2007 005 510 A1, DE 197 26 402 A1 as well as DE 36 389 52 A1.

BACKGROUND

The invention is based on the task to minimize the costs for producing a power switch and to optimize its service life. The task is furthermore to suggest an electric consumer with such an optimized power switch as well as a machine tool with an electric consumer, in particular an electromotor, and a power switch that is assigned to it.

SUMMARY

The invention recognized that the costs for manufacturing a power switch can be reduced if it does not have to be construed anymore for the maximum voltage and current peaks that occur in the state of the art. The invention has furthermore recognized that such a construction of the power switch is not necessary anymore if electric energy is not directly used after operating the power switch in a relevant measure, which means that electric current flows. The power switch shall therefore only serve for switching a reduced current, preferably for a powerless switching on and off, at a switch assembly that is construed according to the concept of the invention. This has then the desired consequence that the power switch has to be construed only for the maximum current load capacity not or only to a minor degree for switching operating currents and powers. The cost reduction that comes with it is the result of minimizing the required contact material amount, as silver, tungsten carbide and similar contact metals. The contact material amount can be reduced because at least approximately powerless switching processes do not underlie the electric wear by contact erosion due to electric arcs, whereby an extended service life can be achieved even at a reduced material use. The invention enables a cost minimized construction of the power switch by providing a help switch (help contact), which serves for generating a start and stop signal for the power electronic, based on which the power electronic begins at the switch-on process to supply the electric consumer (preferably slowly) with electric current and/or at the switch-off process to reduce the current flow to the consumer at least slightly, preferably up to zero, before the power switch is activated. In other words the power electronic is supplied with voltage and current by activating the power switch, but prevents a supply of the consumer with electric energy so long until the help switch is also switched on. Thereupon the current flow is released by the power electronic to the consumer, preferably (slowly) increased, for example by realizing smooth start and/or a current limitation. At the switch-off process the help switch has the task to signalize the power electronic that it has to reduce (quickly) the current flow to the consumer so that the power switch at least does not have to switch the full operating current at the switch-off process.

As an improvement of the invention it is advantageously provided that the help switch and the power switch are coupled in such a way that a switching on of the help switch, thus an activating of the help switch during the switch-on process, is only possible after activating the power switch, which means the power contact. Thereby it is avoided that the consumer is supplied with current directly after activating the power switch. The power switch and the help switch are preferably coupled in such a way that they can be switched with a sufficient time delay in order to avoid improper voltage and/or current peaks when switching the main line with the aid of the power switch.

Additionally or alternatively it is advantageously provided as an improvement of the invention that the coupling between the power switch and the help switch is construed in such a way that the power switch cannot be switched off before the help switch, so that the power electronic has sufficient time before activating the power switch, after activating the help switch to reduce the current flow, in order to maintain that at least not the full operating current, preferably no current has to be switched to the electric consumer with the power switch.

As already mentioned the power electronic is preferably construed in such a way that the current flow to the electric consumer can be regulated by it, preferably in such a way that the power switch does not have to switch at least the full current, preferably no current at all when switching on and/or off. It is especially preferred to construe the power electronic therefore as engine speed regulating electronic. At direct current machines this takes preferably place by pulse width modulation and at alternating current engines for example by a power regulating with the aid of a phase cut end.

With regard to the coupling of the power switch and the help switch there are different possibilities. According to a particularly preferred embodiment the power switch and the help switch are assigned to a common activation mechanism, for example a common press button or rotary switch, whereby the activation mechanism is construed in such a way that the power switch is always turned on first during the switch on process, which means that the main line to the power electronic is released for the current flow before the help switch is turned on, which means that the help contact is switched and the power electronic is thereby signalized to begin with the current supply of the electric consumer. Additionally or alternatively it is preferred to construe the activation mechanism in such a way that the help switch is always turned off first during the switch off process, which means that the help contact is opened before the power switch is switched off, thus the current supply of the power electronic is interrupted.

According to an alternative embodiment the power switch as well as the help switch do not provide common but their individual activation mechanisms, for example each a press button or rotary switch, whereby the activation mechanisms are assigned to at least one block mechanism, which prevents an activation of the activation mechanism of the help switch during the switch on process so long until the power switch is switched on and/or it prevents an activation of the power switch during the switch off process so long until the help switch is switched on.

One embodiment is in particular preferred, at which the help switch is assigned to a control electronic, which request whether the help switch is switched on or not and supplies the power electronic correspondingly with a start or stop signal. The control electronic and power electronic can of course be realized in a common circuit.

With regard to the voltage supply or current supply of the control electronic there are several possibilities. According to a first alternative the control electronic is connected in such a way that it is supplied with electric voltage or electric current directly from the main line after turning on the power switch. According to a second alternative embodiment the control electronic is only supplied with electric current or voltage by turning on the help switch.

The invention also lists an electric consumer, in particular an electromotor, preferably for the use in a machine tool, whereby the electric consumer is assigned to a previously described switch assembly.

Furthermore the invention lists a machine tool, in particular a hand machine tool with an electric consumer, which is assigned to a previously described switch assembly.

BRIEF DESCRIPTION OF THE DRAWINGS

Further advantages, characteristics and details of the invention result from the subsequent description of preferred embodiments as well as the drawings. Those show in.

DETAILED DESCRIPTION

The figures show the same elements and elements with the same function with the same reference signs.

Figure 1:
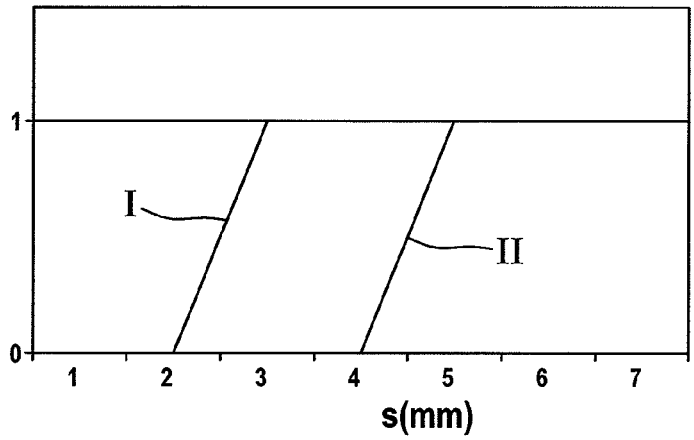
FIG. 1 is a possible switch characteristic line of a switch assembly, comprising a help contact and a power contact.

FIG. 1 shows a diagram (block diagram), in which the switch state (0=off/1=on) is shown above the switch path S. it can be seen that the switch characteristic line (I) of a power switch (main switch) achieves the switch state "on" before a switch characteristic line (II) of a help switch. Furthermore it can be seen in the diagram that the help switch is only activated after the power switch is (completely) turned on.

Figure 2:
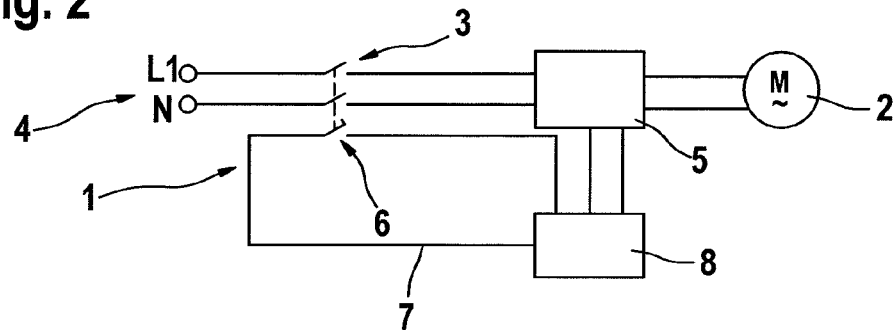
FIG. 2 is a switch assembly for switching a one-phased alternating current engine.

FIG. 2 shows a first embodiment of a switch assembly 1 for switching an electric consumer 2 that is here construed as alternating current engine. It is a single-phased consumer, whereby naturally by a corresponding variation of a power switch 3 that still has to be explained also two- or three-phased (alternating current) consumers 2 can be switched.

The current and voltage supply for the electric consumer 2 takes place over a main line 4, comprising a phase conductor L1 as well as a neutral conductor N. The previously mentioned power switch 3 is integrated in a main line 4, which is construed as bipolar switch, with which simultaneously the phase conductor L1 as well as the neutral conductor N are switched, whereby naturally also a mono-polar power switch (main switch) can be realized. The main line 4 leads to a power electronic 5, with which the consumer power can be regulated in a familiar way. The power electronic 5 comprises in the shown embodiment an engine speed regulation for the electric consumer 2 that is construed as electromotor. In order for the power electronic 5 to supply the consumer 2 with electric current it is not enough to only activate the power switch 3. Moreover a help switch 6 must be switched—timely slightly shifted—which is arranged in a help circuit 7 in the shown embodiment, which is supplied by a control electronic 8 with electric current/electric voltage. If the help switch 6 is activated (after switching on the power switch 3) the power electronic 5 receives a start signal from the control electronic 8 to supply the electronic consumer 2 with electric energy, whereby the energy delegation is increased (preferably slowly) and is not directly realized with a maximum. The power switch 3 is coupled with the help switch 6 in such a way that the help switch 6 is turned on automatically delayed after the power switch 3. During the switch off process the power switch 3 is blocked until the help switch 6 is turned off. When the help switch 6 is turned off the energy supply of the electric consumer 2 is reduced preferably to zero, so that it is basically the only task of the power switch 3 to open a contact, which means to create a galvanic separation. The power switch 3 has thus not have to be construed for the current switch.

Figure 3:
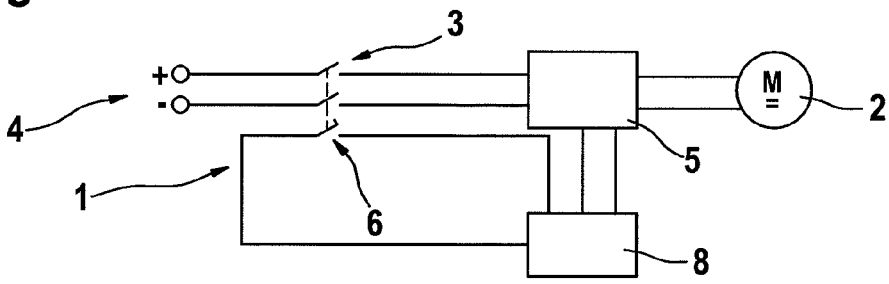
FIG. 3 is a switch assembly for switching a direct current engine.

The embodiment according to FIG. 3 basically corresponds with the embodiment according to FIG. 2 with the only difference that the electric consumer 2 is a direct current engine. The power electronic 5 is correspondingly adjusted to the engine speed regulation of an electric direct current engine. Like in the embodiment according to FIG. 2 the help switch 6 and the power switch 3 are mechanically coupled in such a way that a delayed activation is maintained.

Figure 4:
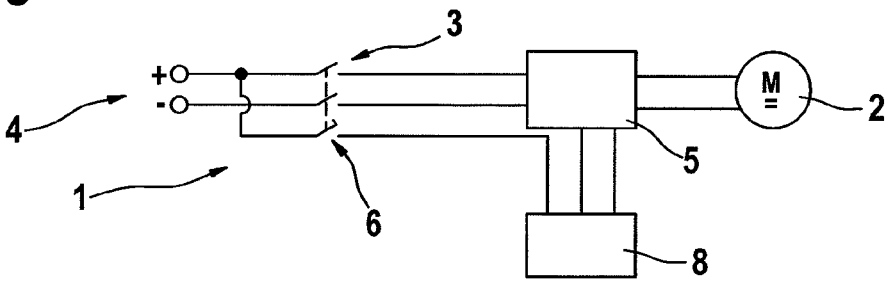
FIG. 4 is an alternative embodiment of a switch assembly for switching a direct current engine.

In the embodiment according to FIG. 4 the switch assembly 1 is construed just as in the embodiment according to FIG. 3 to switch an electric consumer 2 that is construed as a direct current motor. The difference is though that the control electronic 8 is directly supplied with electric voltage by the help switch 6, which is correspondingly connected with the positive pole of the main line 4.

The invention claimed is:

1. A switch assembly for switching an electric consumer on and off in a hand machine tool, comprising a power switch and a power electronic for supplying the electric consumer with electric energy, wherein a help switch is provided, which works together with the power electronic in such a way that it supplies the electric consumer with electric energy not until after switching on the help switch, wherein the help switch can be switched on during the switch on process only after switching on the power switch, and wherein the power switch can be switched off during the switch off process only after switching off the help switch.

2. The switch assembly according to claim 1, wherein the power electronic is construed in such a way that it regulates the current flow preferably in such a way that the achieving of a maximum current flow is delayed during the switch on process and/or in such a way that the achieving of a minimum current flow is accelerated during the switch off.

3. The switch assembly according to claim 1, wherein the power switch and the help switch are assigned to a common activation mechanism, which is construed in such a way that the help switch is switched on during the switch on process after the power switch and/or that the help switch is switched off during the switch off process before the power switch.

4. The switch assembly according to claim 1, wherein the power switch as well as the help switch are each assigned to activating mechanism, and that at least one block mechanism is provided, which prevents the switching on of the help switch during the switching on process before switching on the power switch and/or which prevents a switching off of the power switch before switching off the help switch.

5. The switch assembly according to claim 1, wherein the help switch is assigned to a control electronic, which sends a start signal to the power electronic after switching on the help switch and/or a stop signal after switching off the help switch.

6. The switch assembly according to claim 5, wherein the electric energy supply of the control electronic can be switched with the help switch, or that the control electronic can be supplied with electric energy independent of a help circuit that provides a help switch.

7. An electromotor, with a switch assembly according to claim 1.

8. A machine tool with an electric consumer according to claim 7 for driving a rotating tool.

* * * * *